US009272874B1

(12) United States Patent
Davis, Jr.

(10) Patent No.: US 9,272,874 B1
(45) Date of Patent: Mar. 1, 2016

(54) SYSTEM FOR DEPLOYING AND RETRIEVING HOSE USED IN FLUID TRANSPORTATION IN HYDRAULIC FRACTURING OPERATIONS

(71) Applicant: Joe B. Davis, Jr., Houston, TX (US)

(72) Inventor: Joe B. Davis, Jr., Houston, TX (US)

( * ) Notice: Subject to any disclaimer, the term of this patent is extended or adjusted under 35 U.S.C. 154(b) by 268 days.

(21) Appl. No.: 14/090,002

(22) Filed: Nov. 26, 2013

Related U.S. Application Data

(60) Provisional application No. 61/730,471, filed on Nov. 27, 2012.

(51) Int. Cl.
*B65H 51/08* (2006.01)

(52) U.S. Cl.
CPC ..... *B65H 51/08* (2013.01)

(58) Field of Classification Search
CPC ..... B65H 51/08; B65H 51/10; B65H 51/32; B65H 51/12
See application file for complete search history.

(56) References Cited

U.S. PATENT DOCUMENTS

| | | | | |
|---|---|---|---|---|
| 3,829,064 | A * | 8/1974 | Jackson | B66D 1/28 254/134.3 R |
| 5,139,751 | A * | 8/1992 | Mansfield | B05B 13/06 118/306 |
| 5,938,100 | A * | 8/1999 | Bloser | B27F 7/21 227/107 |
| 2012/0118397 | A1 | 5/2012 | Novotny et al. | |

* cited by examiner

*Primary Examiner* — Michael McCullough
(74) *Attorney, Agent, or Firm* — Buskop Law Group, PC; Wendy Buskop

(57) ABSTRACT

A system for deploying and retrieving hose used in fluid transportation in hydraulic fracturing operations that is easy to operate. The system for deploying and retrieving hose used in fluid transportation in hydraulic fracturing operations includes a mounting plate configured to move about a slide rail system secured to a support structure and an apparatus for loading and unloading hose that is secured to a top of the mounting plate. The apparatus can rotate 360 degrees.

8 Claims, 6 Drawing Sheets

SYSTEM FOR DEPLOYING AND RETRIEVING HOSE USED IN FLUID TRANSPORTATION IN HYDRAULIC FRACTURING OPERATIONS

CROSS REFERENCE TO RELATED APPLICATION

The present application claims priority to and the benefit of U.S. Provisional Patent Application Ser. No. 61/730,471 filed on Nov. 27, 2012, entitled "SYSTEM FOR DEPLOYING AND RETRIEVING HOSE USED IN FLUID TRANSPORTATION IN HYDRAULIC FRACTURING OPERATIONS." This reference is hereby incorporated in its entirety.

FIELD

The present embodiments generally relate to system for deploying and retrieving hose used in fluid transportation in hydraulic fracturing operations.

BACKGROUND

A need exists for a system for deploying and retrieving hose used in fluid transportation in hydraulic fracturing operations that is easy to use.

A further need exists for a system for deploying and retrieving hose used in fluid transportation in hydraulic fracturing operations that can be adjusted about rail positions to allow hose on either side of a support structure to be retrieved.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The present embodiments relate to system for deploying and retrieving hose used in fluid transportation in hydraulic fracturing operations.

Figure 1A:
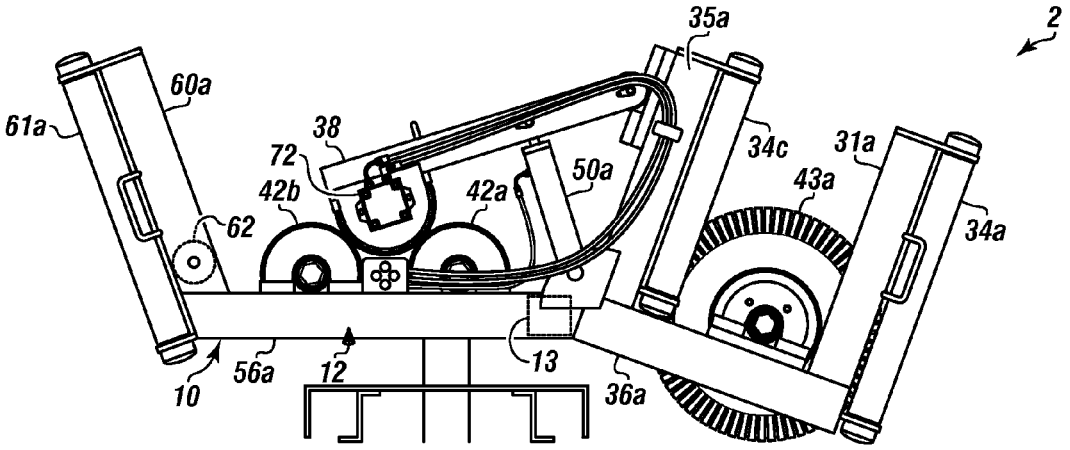
FIG. 1A depicts a first side view of an apparatus.
Figure 1B:
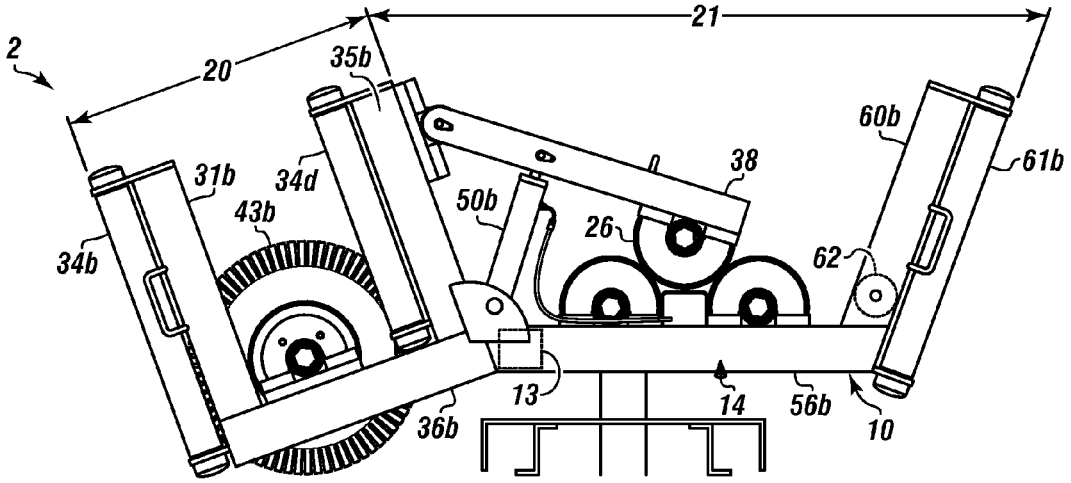
FIG. 1B depicts a second side view of the apparatus of FIG. 1A.

Turning now to the Figures, FIG. 1A depicts a first side view of an apparatus. FIG. 1B depicts a second side view of the apparatus of FIG. 1A.

Referring to FIGS. 1A and 1B, the apparatus 2 can include a frame 10. The frame 10 can be made from any material. Illustrative materials can include powder coated steel, metal, composites, alloys, or the like.

The frame 10 can have any dimension. For example, the frame can have a width from about 2 feet to about 5 feet and a length of about 3 feet to about 8 feet. The frame can be made from hollow steel tubular or solid channel steel, tubular members, angle iron members, I-beam members, C-channel members, or other structural members.

The frame 10 can have a first side 12. The first side 12 can be connected with a second side 14 by a cross member 13.

The distance between the first side 12 and the second side 14 can be configured to allow the hose to pass therethrough. In embodiments, the frame 10 can have a distance between the first side 12 and the second side 14 that ranges from about 1.5 feet to about 2.5 feet.

The frame 10 can include a first segment 20 and a second segment 21. Each segment can have a length of from about 1 foot to about 3 feet long. The first segment 20 can be connected to the second segment 21 at an angle ranging from about 5 degrees to about 45 degrees.

The first side 12 of the first segment 20 can have a first base rail 36*a*. The second side 14 of the first segment 20 can have a second base rail 36*b*.

The first base rail 36*a* and the second base rail 36*b* can support one or more lead rollers 43*a* and 43*b*. The lead rollers can be sized to guide a hose and ensure that couplings or other obstructions on the hose do not get stuck as the hose is deployed or retrieved. In an embodiment two lead rollers can be used. The one or more lead rollers 43*a* and 43*b* can be pneumatic tires.

The first segment 20 can include a first roller support 31*a*, a second roller support 31*b*, a third roller support 35*a*, and a fourth roller support 35*b*. The first roller support 31*a* and the third roller support 35*a* can be connected with the first base rail 36*a*, and the second roller support 31*b* and the fourth roller support 35*b* can be connected with the second base rail 36*b*. The first roller support 31*a* and the third roller support 35*a* can extend from the first base rail 36*a*. The second roller support 31*b* and the fourth roller support 35*b* can extend from the second base rail 36*b*.

The first roller support 31*a* can support a first roller 34*a* and the second roller support 31*b* can support a second roller 34*b*. The third roller support 35*a* can support a third roller 34*c*, and the fourth roller support 35*b* can support a fourth roller 34*d*. The first roller 34*a*, the second roller 34*b*, the third roller 34*c*, and the fourth roller 34*d* can be supported such that they rotate freely. The first roller 34*a*, the second roller 34*b*, the third roller 34*c*, and the fourth roller 34*d* can guide the hose as it is urged through the apparatus 2, preventing the hose from getting stuck on the frame or being damaged.

A drive arm 38 can be operatively connected with the frame 10. For example, the drive arm 38 can be connected with the third roller support 35*a* and the fourth roller support 35*b*. The drive arm 38 can be connected with the third roller support 35*a* and the fourth roller support 35*b* by pivot bearings, pins, or the like.

The drive arm 38 can be moved by one or more powered cylinders 50*a* and 50*b*. The powered cylinders 50*a* and 50*b* can be supported by the cross member 13 or another portion of the frame 10.

The powered cylinders 50*a* and 50*b* can be pneumatic cylinders, hydraulic cylinders, worm gears, ball screws, mechanical actuators, or the like.

A top drive roller 26 can be connected with the drive arm 38.

The second segment 21 can include a third base rail 56*a* and a fourth base rail 56*b*.

The third base rail 56*a* and the fourth base rail 56*b* can operatively support one or more lower drive rollers 42*a* and 42*b*. The top drive roller 26 can be selectively aligned in an operative position with the lower drive roller 42*a* and 42*b*.

The third base rail 56*a* can be connected with a fifth roller support 60*a*, and the fourth base rail 56*b* can be connected with a sixth roller support 60*b*. The fifth roller support 60*a* can operatively support a fifth roller 61*a*, and the sixth roller support 60*b* can operatively support a sixth roller 61*b*. The fifth roller 61*a* and the sixth roller 61*b* can be supported such that they can move freely. The fifth roller 61*a* and the sixth roller 61*b* can guide the hose as it passes through the apparatus.

A frame roller 62 can be supported by the fifth roller support 60*a* and the sixth roller support 60*b*.

As the hose is urged through the apparatus into the support structure, the rollers 34*a*, 34*b*, 34*c*, 34*d*, 61*a*, 61*b*, and 62 can guide the hose to ensure that no pitch points form. The rollers 34*a*, 34*b*, 34*c*, 34*d*, 61*a*, 61*b*, and 62 can also prevent contact of the hose with the frame 10, reducing friction wear of the hose.

The powered cylinders 50*a* and 50*b* can be connected with a power system. A motor 72 can be operatively connected with the power system.

The motor 72 can be a pneumatic motor, an electric motor, an internal combustion engine, a hydraulic motor, or the like. In one or more embodiments, a drive power system can be connected with the motor 72 instead of the power system. For example, if the motor 72 is an electric motor a power source and electric control panel can be operatively connected with the motor 72 to drive and control the motor 72. The electric control panel can be a variable speed drive controller. The connection of the motor and powering of the motor is known to one skilled in the art with the aid of this disclosure.

The motor 72 can drive the top drive roller 26, one or more of the lower drive rollers 42*a* and 42*b*, or combinations thereof.

In one or more embodiments, the top drive roller 26, one or more of the lower drive rollers 42*a* and 42*b*, or combinations thereof can be an idler roller as long as at least one of the drive rollers 26, 42*a*, and 42*b* is powered by the motor 72.

Figure 2:
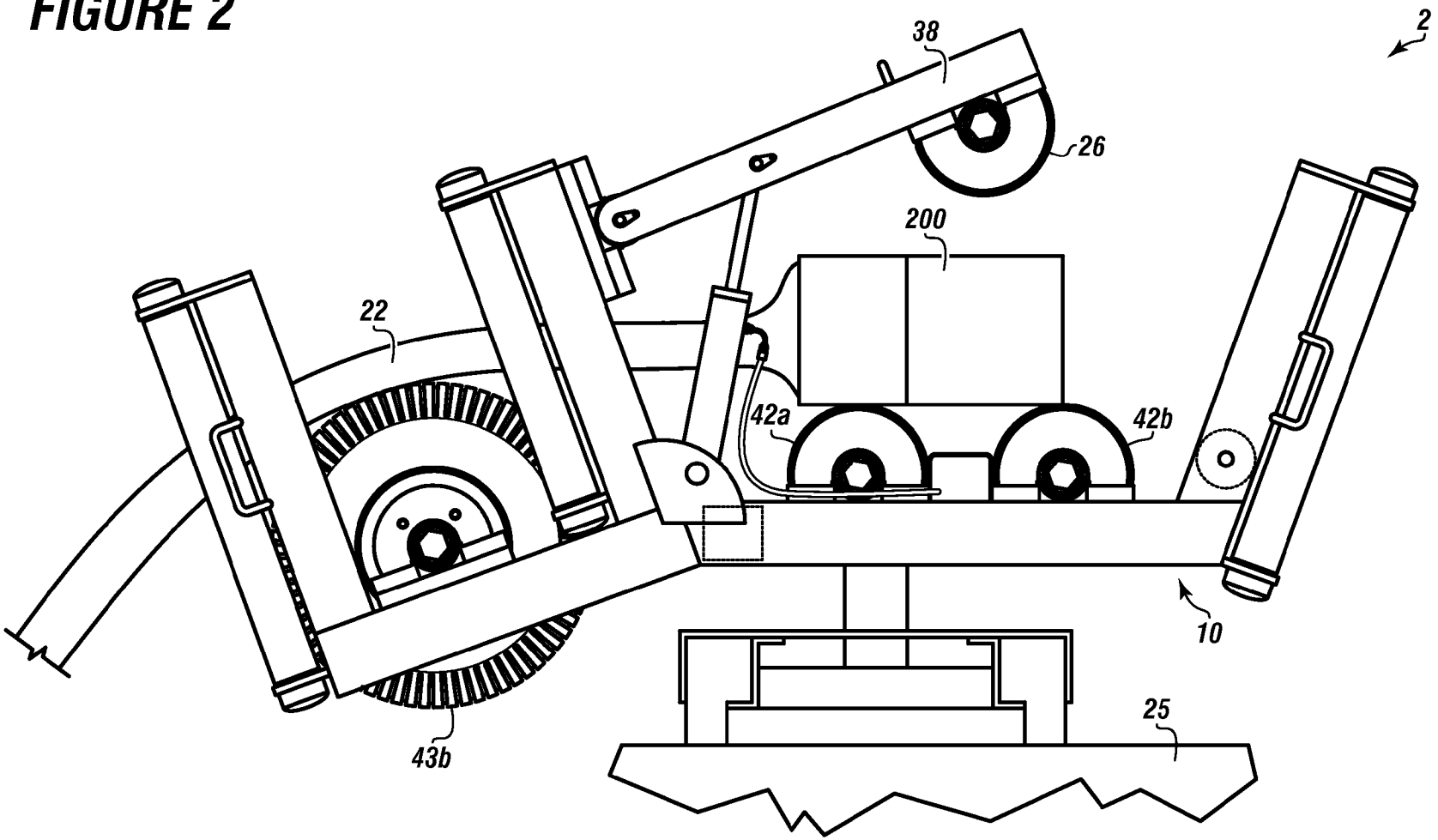
FIG. 2 depicts a hose being retrieved into a support structure.

FIG. 2 depicts a hose being retrieved into a support structure.

The support structure 25 can be a trailer, a vehicle, a crate, a building, a skid, or the like.

The apparatus 2 can be connected with the support structure 25. To start retrieving the hose with the apparatus 2, a proximate end 200 of the hose 22 can be placed onto at least a portion of the lower drive rollers 42*a* and 42*b*. The proximate end 200 can be placed on at least a portion of the lower drive rollers 42*a* and 42*b* using a strap. The strap can be a rope or the like. A double loop can be formed on the strap and the double loop can be connected with the proximate end 200 of the hose 22. The strap can be lifted by hand and the hose can be loaded on the apparatus 2.

Once the hose 22 is positioned on the apparatus 2, the drive arm 38 can be lowered so that the top drive roller 26 is operatively engaged with the hose 22. The top drive roller 26 and the lower drive rollers 42*a* and 42*b* can cooperate to urge the hose 22 through the apparatus 2 into the support structure 25.

The frame 10 and lead roller 43*b* are also depicted in this Figure.

Figure 3:
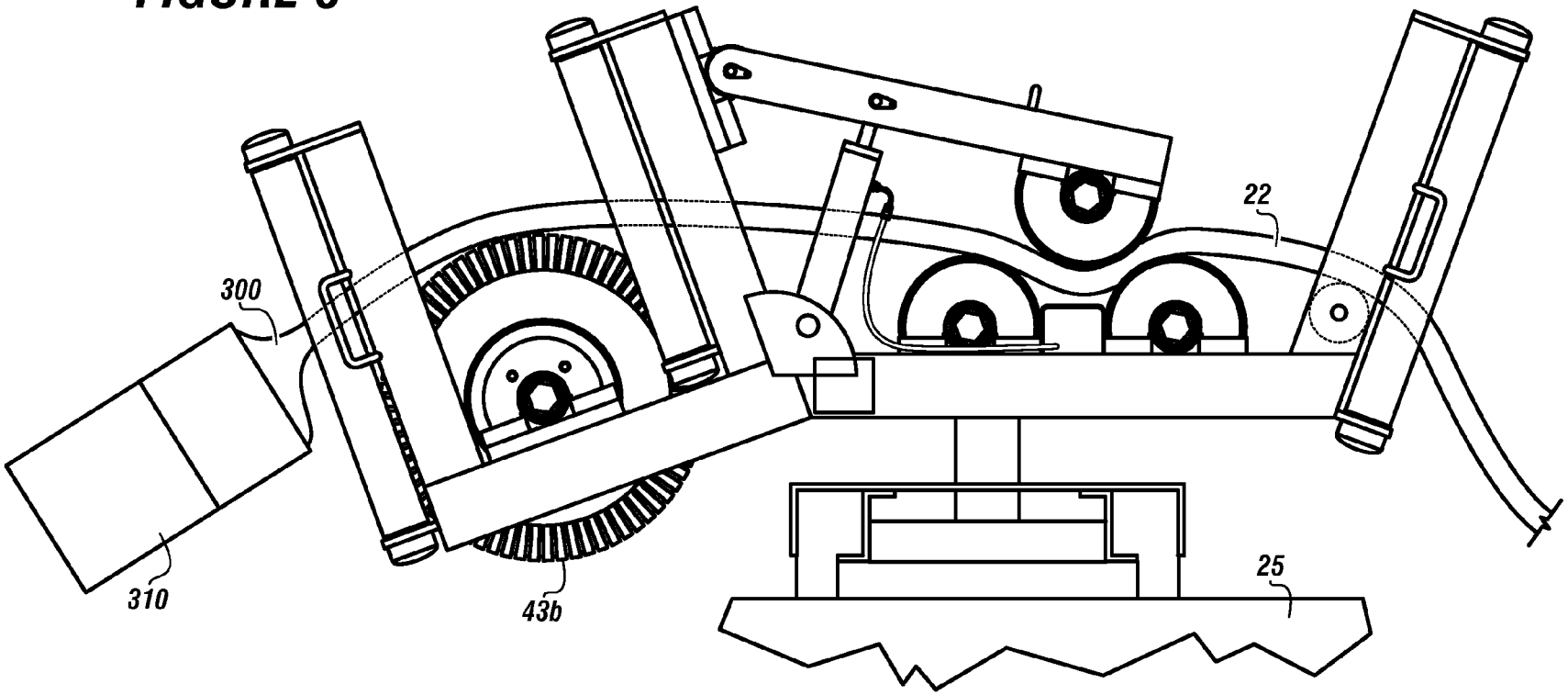
FIG. 3 depicts the hose being loaded into the support structure wherein the distal end of the hose is resting on the lead roller.

FIG. 3 depicts the hose being loaded into the support structure wherein the distal end of the hose is resting on the lead roller.

The support structure 25 is shown. A distal end 300 of the hose 22 can have a coupling 310. The coupling 310 can be guided by the lead rollers; lead roller 43*b* is shown. The lead rollers, by guiding the coupling 310, can ensure a smooth operation and eliminate the need for manual lifting or other intervention to prevent the coupling 310 from catching on the frame. The radius of the lead rollers can aid in guiding the coupling 310 to ensure that no binding occurs.

Figure 4:
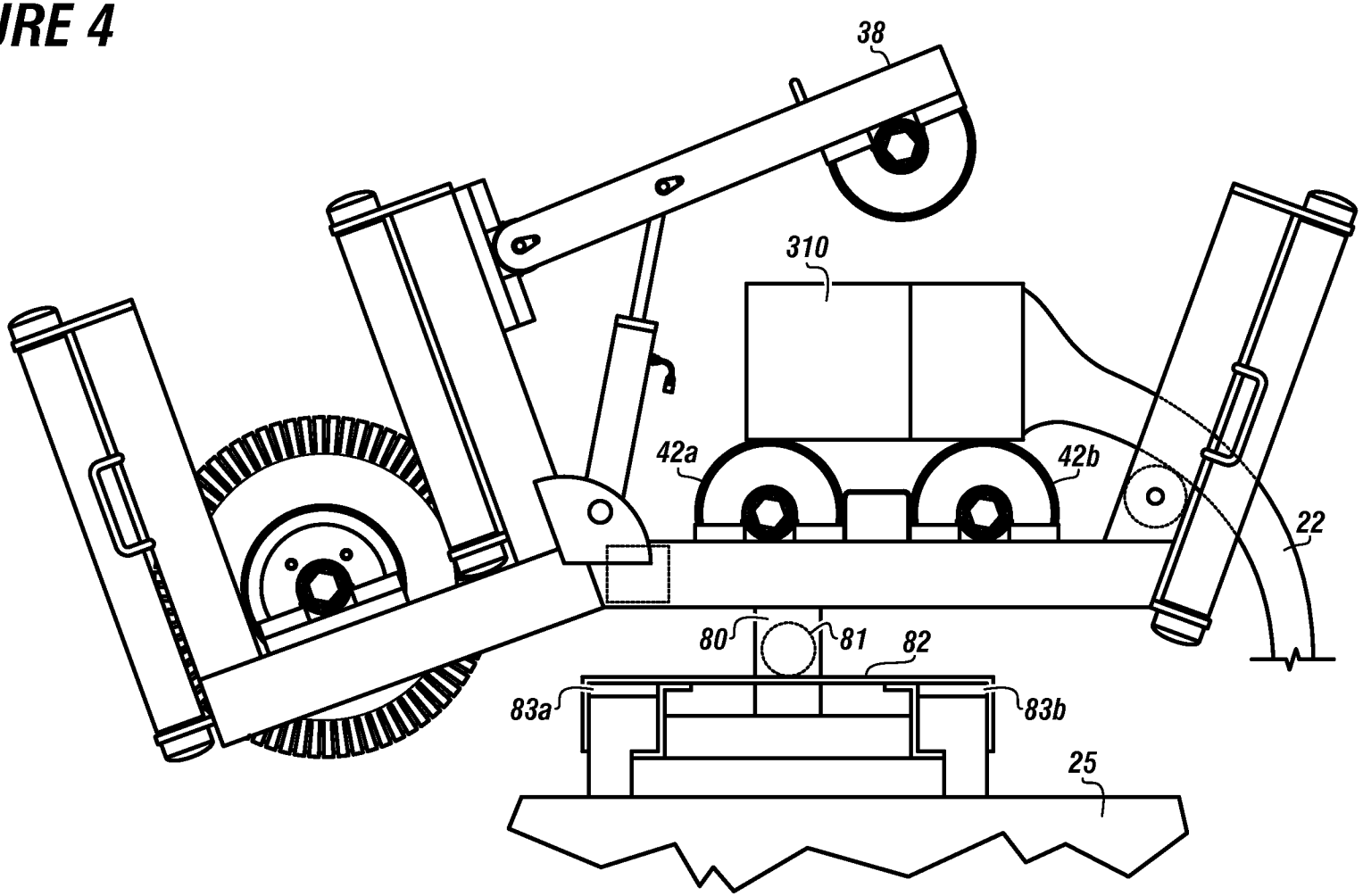
FIG. 4 depicts the apparatus feeding the hose into the support structure once the coupling has moved to at least a portion of the lower drive rollers.

FIG. 4 depicts the apparatus feeding the hose into the support structure once the coupling has moved to at least a portion of the lower drive rollers.

The drive arm 38 can be lifted to allow the coupling 310 to pass over the lower drive rollers 42*a* and 42*b*. An operator can manually place the coupling 310 of the hose 22 into the support structure 25.

The apparatus can be operated to retrieve a plurality of hose sections connected together by couplings. The drive arm can be lifted each time a coupling in presented to allow the coupling to pass through the apparatus. The ability to raise the drive arm allows a plurality of connected hose sections to be retrieved without the need to disconnect them.

The apparatus can be connected with the support structure 25 by a rotating member 80. The rotating member 80 can be a ball joint, a swivel joint, or another connection member capable of 360 degree rotation.

One or more locking pins 81 can be configured to lock the apparatus in a desired position.

The rotating member 80 can be connected with a mounting plate 82. The mounting plate 82 can be operatively engaged with mounting rails 83*a* and 83*b*. The mounting plate 82 can be moved about the mounting rails 83*a* and 83*b* to move the apparatus horizontally relative to the support structure 25.

One or more locking mechanisms can be used to lock the mounting plate in position. For example, a first receiving hole can be located in the mounting rails adjacent a first end of the mounting rails, a second receiving hole can be located in the mounting rails adjacent a second end of the mounting rails, and a third receiving hole can be located between the first receiving hole and the second receiving hole.

A spring loaded locking pin can be operatively disposed through the mounting plate. Consequently, to move the apparatus the spring loaded locking pin can be pulled away from the mounting rails, and as the apparatus moves along the mounting rails, the spring loaded locking pin can snap into one of the receiving holes when aligned therewith.

Figures 5A, 5B:
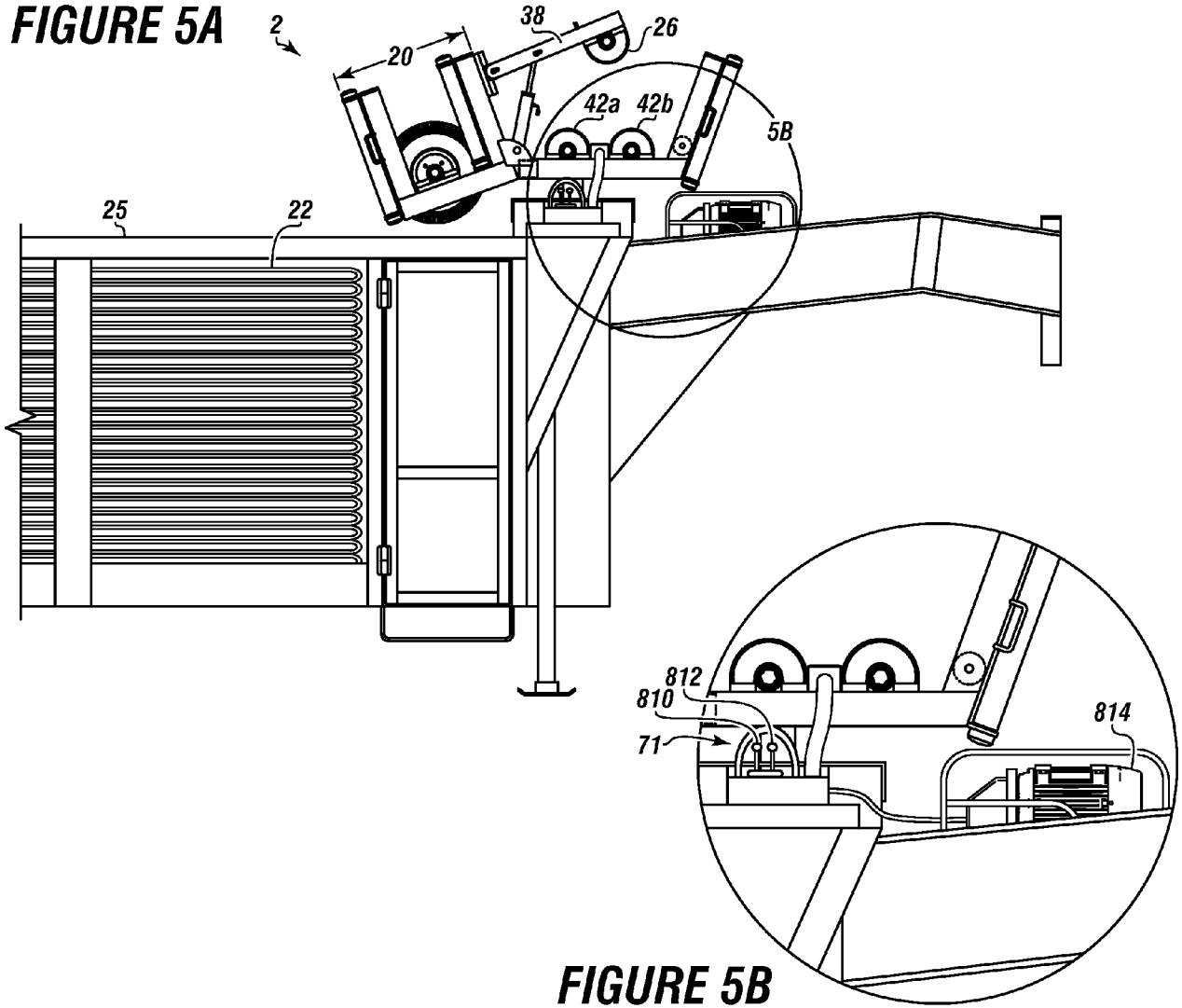
FIG. 5A depicts a support structure with the hose stored therein and the apparatus in a travel position.
FIG. 5B depicts a detailed view of a power system.

FIG. 5A depicts a support structure with the hose stored therein and the apparatus in a travel position.

The hose 22 can be stored in the support structure 25. The apparatus 2 can be in a travel position with the drive arm 38 positioned such that the top drive roller 26 is adjacent the lower drive rollers 42*a* and 42*b*.

The first segment 20 is rotated to be proximate the support structure 25.

FIG. 5B depicts a detailed view of a power system.

The power system 71 can include a cylinder control 810 and a drive roller control 812. A power supply 814 can energize the powered cylinders and the motor. The cylinder control 810 and the drive roller control 812 can control the delivery of the operation of the powered cylinders and the motor.

The cylinder control 810 and the drive roller control 812 can be remote from the apparatus. The cylinder control 810 and the drive roller control 812 can communicate with the power system.

The power supply 814 can be a hydraulic pump, a pneumatic pump, an electric power source, an internal combustion engine, or the like.

Referring to FIGS. 5A and 5B, the apparatus 2 can deploy hose 22 from the support structure 25. The first segment 20 is proximate the support structure 25. The hose 22 can be loaded into the apparatus 2 by placing at least a portion of a proximate end of the hose 22 on at least a portion of the lower drive rollers 42*a* and 42*b*.

The drive arm 38 can be moved to operatively engage the top drive roller 26 with the hose 22, and the power system 71 can be operated to drive one or more of the drive rollers. The top drive roller 26 and the lower drive rollers 42*a* and 42*b* can cooperate to urge the hose 22 through the apparatus 2 and to a desired deployment location. The desired location can be a work site, a container, or the like.

Figure 6:
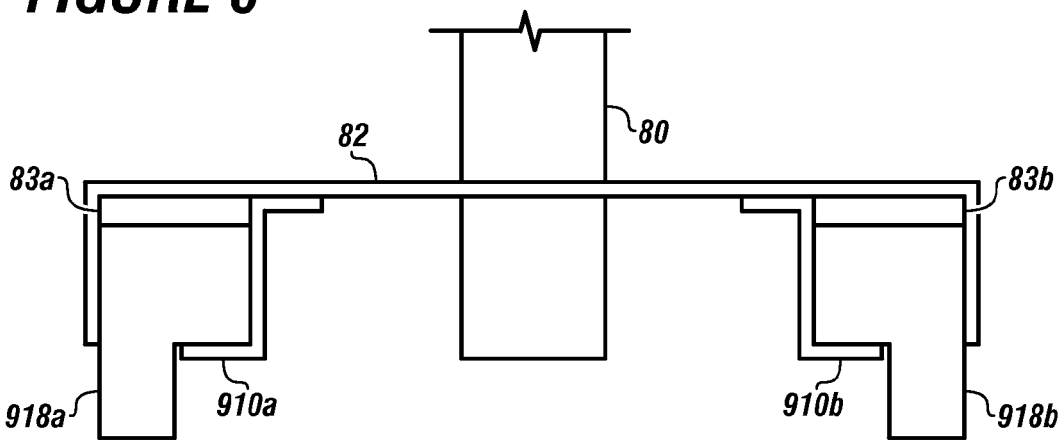
FIG. 6 depicts left detailed view of the mounting rails and the mounting plate engaged therewith.

FIG. 6 depicts left detailed view of the mounting rails and the mounting plate engaged therewith.

The mounting rails 83*a* and 83*b* can be supported by support blocks 918*a* and 918*b*.

The mounting plate 82 can be engaged with the mounting rails 83*a* and 83*b*. Slide guides 910*a* and 910*b* can guide the mounting plate 82 about the mounting rails 83*a* and 83*b*.

The rotating member 80 can be connected with the mounting plate 82.

While these embodiments have been described with emphasis on the embodiments, it should be understood that within the scope of the appended claims, the embodiments might be practiced other than as specifically described herein.

What is claimed is:

1. A system for deploying and retrieving hose used in fluid transportation in hydraulic fracturing operations, wherein the system comprises:

a. a mounting plate;

b. a first slide guide secured to a bottom of the mounting plate on a first portion thereof;

c. a second slide guide secured to the bottom of the mounting plate on a second portion thereof; wherein the first slide guide and the second slide guide are operatively aligned with one another;

d. a slide rail system secured to a support structure, wherein the slide rail system comprises:

(i) a pair of horizontal rails aligned with one another and spaced apart from one another;

(ii) a first support block supporting one horizontal rail of the pair of horizontal rails; and (iii) a second support block supporting another horizontal rail of the pair of horizontal rails, wherein the first slide guide is configured to move about one of the horizontal rails of the pair of horizontal rails and the second slide guide is configured to move about the other horizontal rail of the pair of horizontal rails; and e. an apparatus for loading and unloading hose secured to a top of the mounting plate, wherein the apparatus for loading and unloading hose comprises:

(i) a frame having a first segment connected with a second segment, wherein the first segment is at an angle of from five degrees to forty-five degrees with the second segment;

(ii) at least one lower drive roller secured to the second segment;

(iii) a drive arm secured to the frame;

(iv) a top drive roller secured with the drive arm, wherein the top drive roller can be operatively aligned with the lower drive roller by moving the drive arm;

(v) at least one roller support connected with the frame;

(vi) at least one roller operatively supported by the at least one roller support;

(vii) at least one lead roller secured with the first segment; and (viii) a frame roller secured with the second segment opposite the first segment.

2. The system of claim 1, wherein the drive arm is moved using at least one powered cylinder.

3. The system of claim 1, wherein the at least one lead roller is a pair of tires mounted to a shaft.

4. The system of claim 3, wherein the pair of tires are pneumatic tires.

5. The system of claim 1, comprising a first powered cylinder attached between the drive arm and the frame, and a second powered cylinder attached between the drive arm and the frame opposite the first powered cylinder, for raising or lowering the drive arm.

6. The system of claim 1, wherein the mounting plate is connected with the frame using a rotating member.

7. The system of claim 1, wherein the top drive roller, the at least one lower drive roller, or both are powered by a motor.

8. The system of claim 1, wherein the top drive roller or the at least one lower drive roller is an idler roller.

* * * * *